US007549870B2

(12) United States Patent
Mason et al.

(10) Patent No.: US 7,549,870 B2
(45) Date of Patent: Jun. 23, 2009

(54) ELECTRICAL INTERCONNECT DEVICE UTILIZING CONTACT CAPS

(75) Inventors: Jeffery W. Mason, North Attleboro, MA (US); Wayne Stewart Alden, III, Whitman, MA (US); Chuan Yue, North Attleboro, MA (US); Shiraz Sameja, South Attleboro, MA (US); Peter Wapenski, Foster, RI (US); Vishwa N. Shukla, North Attleboro, MA (US); Edward MacPherson, Attleboro, MA (US); Robert D. Hilty, Harrisburg, PA (US); George Chou, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 35 days.

(21) Appl. No.: 11/648,999

(22) Filed: Jan. 3, 2007

(65) Prior Publication Data

US 2008/0160794 A1 Jul. 3, 2008

(51) Int. Cl.
*H01R 12/00* (2006.01)

(52) U.S. Cl. ..... 439/66; 439/91

(58) Field of Classification Search ..... 439/66, 439/91

See application file for complete search history.

(56) References Cited

U.S. PATENT DOCUMENTS 4,548,451 A * 10/1985 Benarr et al. ..... 439/85
5,007,842 A * 4/1991 Deak et al. ..... 439/66
5,163,834 A * 11/1992 Chapin et al. ..... 439/66
5,388,997 A * 2/1995 Grange et al. ..... 439/66
5,599,193 A * 2/1997 Crotzer ..... 439/66
6,056,557 A * 5/2000 Crotzer et al. ..... 439/66
6,106,305 A * 8/2000 Kozel et al. ..... 439/66
6,271,482 B1 * 8/2001 Crotzer et al. ..... 174/262
6,764,313 B2 7/2004 Hougham
6,790,057 B2 9/2004 DelPrete et al.
6,939,143 B2 * 9/2005 Rathburn ..... 439/66
7,070,420 B1 * 7/2006 Wakefield et al. ..... 439/66
7,331,796 B2 * 2/2008 Hougham et al. ..... 439/66
2002/0127893 A1 * 9/2002 Brodsky ..... 439/66
2003/0186572 A1 10/2003 Hougham et al.
2004/0110322 A1 6/2004 Hougham et al.
2006/0003648 A1 1/2006 Hougham et al.
2006/0009050 A1 1/2006 Hougham et al.

FOREIGN PATENT DOCUMENTS

WO WO 2004/039135 A1 5/2004

* cited by examiner

*Primary Examiner*—Neil Abrams
*Assistant Examiner*—Harshad C Patel

(57) ABSTRACT

An electrical interconnect device includes a substrate having opposite outer surfaces and an array of conductive elastomeric columns held by the substrate. Each of the columns have opposite ends that extend beyond respective ones of the outer surfaces of the substrate. Conductive contact caps are disposed over the opposite ends of each said column. An electrical path is defined from one of the contact caps, through the conductive elastomeric column, to another of the contact caps. Optionally, the contact caps may be sized and shaped substantially similarly as the ends of the elastomeric columns. The contact caps may be adhered to the ends of the columns, or alternatively, the contact caps may be adhered to the substrate.

20 Claims, 5 Drawing Sheets

ELECTRICAL INTERCONNECT DEVICE UTILIZING CONTACT CAPS

BACKGROUND OF THE INVENTION

This invention relates generally to an electrical interconnect device for use between opposed arrays of contacts, and more particularly, to an electrical interconnect device having elastomeric columns that provide an electrical connection between the opposed arrays of contacts.

Interconnect devices are used to provide electrical connection between two or more opposing arrays of contacts for establishing at least one electrical circuit, where the respective arrays may be provided on a device, printed circuit board, Pin Grid Array (PGA), Land Grid Array (LGA), Ball Grid Array (BGA), and the like. In one interconnect technique, the electrical connection is provided by an interconnect device that is physically interposed between corresponding electrical contacts of the opposing arrays of contacts. However, the electrical connection may be unreliable due to height variations between electrical contacts of the opposing arrays, variations in thickness of a substrate supporting either of the opposing arrays or the conductive elements of the interconnect device, warping of a substrate of either of the opposing arrays, and the like.

At least some known interconnect devices use an array of elastomeric columns supported on a substrate. The elastomeric columns may be compressed to establish reliable contact between the opposing contacts. In some known interconnect devices, the elastomeric columns are conductive and provide the electrical connection. In other known interconnect devices, the elastomeric columns are non-conductive and the electrical connection is provided via a separate contact or trace. The interconnect devices are capable of accommodating size constraints, such as related to the reduced physical size of many electrical devices. Additionally, the interconnect devices may be non-permanently installed for accommodating the need to remove or replace components of an established electrical circuit(s).

In known interconnect devices using conductive elastomeric columns, the elastomeric columns are directly engaged with the contacts. With use, the elastomeric column conforms to the contact surface and, over time, bonds to the contact surface due to the high temperature created between the two elements. Once the two elements are bonded, it is difficult to remove the components from one another. Additionally, polymer material of the elastomeric column transfers to the contact surface, and a portion of the polymer material may be permanently adhered to the contact surface.

BRIEF DESCRIPTION OF THE INVENTION

In one aspect, an electrical interconnect device is provided including a substrate having opposite outer surfaces and an array of conductive elastomeric columns held by the substrate. Each of the columns have opposite ends that extend beyond respective ones of the outer surfaces of the substrate. Conductive contact caps are disposed over the opposite ends of each said column.

An electrical path is defined from one of the contact caps, through the conductive elastomeric column, to another of the contact caps. Optionally, the contact caps may be sized and shaped substantially similarly as the ends of the elastomeric columns. The contact caps may be adhered to the ends of the columns, or alternatively, the contact caps may be adhered to the substrate.

In another aspect, an electrical interconnect device is provided including a substrate having opposite outer surfaces and multiple openings extending between the outer surfaces, and an array of conductive elastomeric columns held within the openings of the substrate. Each of the columns have opposite ends that extend beyond respective ones of the outer surfaces of the substrate. Contact caps are adhered to one of the outer surfaces of the substrate and are disposed over one of the ends of a respective one of the columns.

In a further aspect, an electrical interconnect device is provided for use with an electrical interconnect system having first and second electrical components opposed from one another, wherein each of the first and second electrical components having an array of contacts. The electrical interconnect device includes a substrate having opposite outer surfaces, and an array of elastomeric columns held by the substrate. Each of the columns have opposite first and second ends that extend beyond respective ones of the outer surfaces of the substrate and are configured to be aligned with respective ones of the contacts of the first and second electrical components. A first set of contact caps is disposed over the first ends of the columns, wherein each contact cap of the first set is configured to engage a corresponding first electrical component contact. A second set of contact caps is separately provided from the first set of contact caps, and each contact cap of the second set is disposed over the second ends of the columns. Each contact cap of the second set is configured to engage a corresponding second electrical component contact.

DETAILED DESCRIPTION OF THE INVENTION

Figure 1:
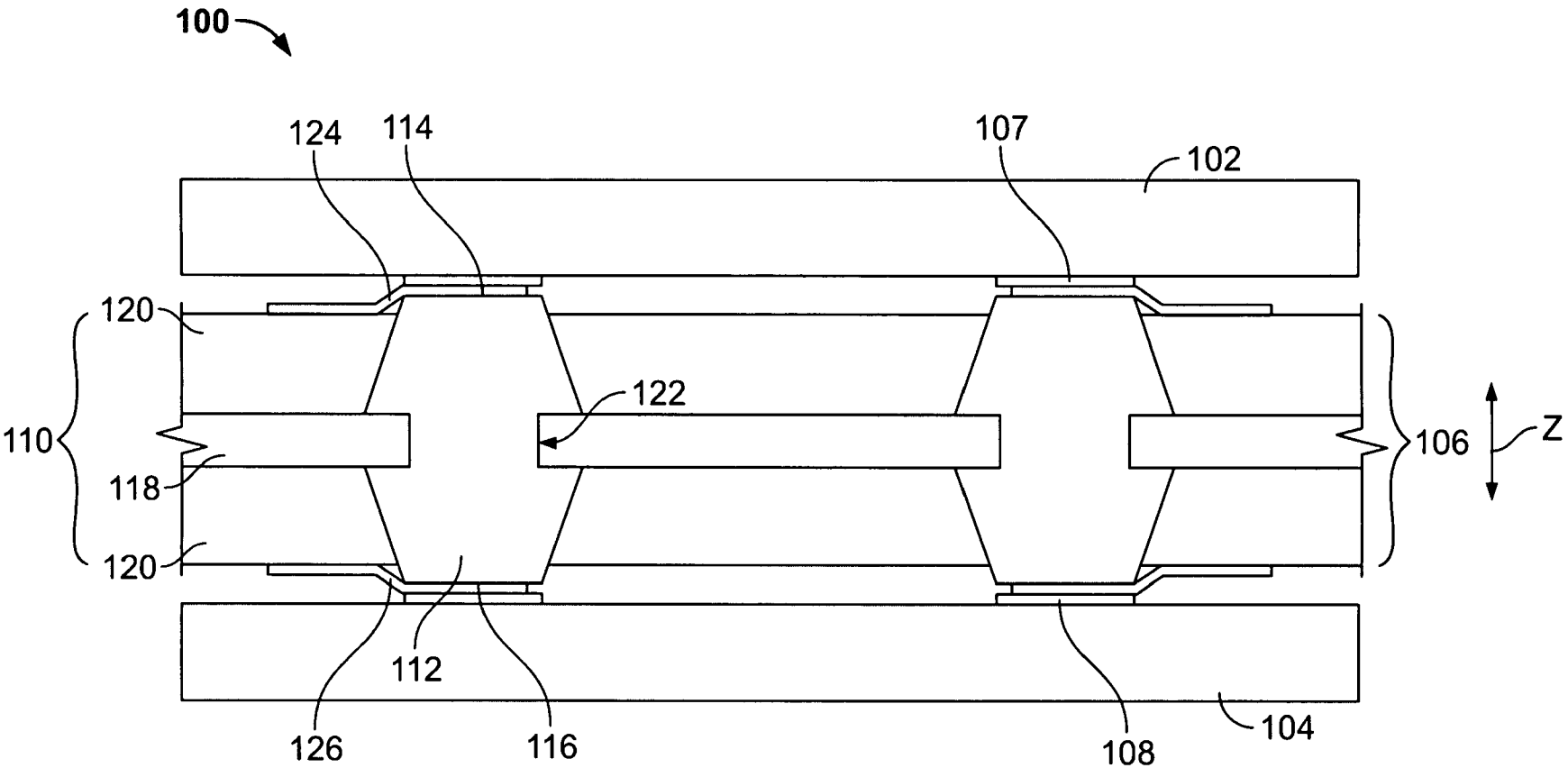
FIG. 1 is a side view of an exemplary electrical interconnect system formed in accordance with an exemplary embodiment.

FIG. 1 is a side view of an exemplary electrical interconnect system 100 formed in accordance with an exemplary embodiment. The system 100 includes a first electrical component 102, a second electrical component 104, and an interconnect device 106 sandwiched therebetween. The first and second electrical components 102 are illustrated in FIG. 1 as printed circuit boards, but other types of components 102, 104 may be used, such as grids. The components 102, 104 are generally planar and spaced apart by a Z-distance (shown by an arrow Z in FIG. 1). An array of contacts 107 are oriented along the inwardly facing surface of the component 102, and an array of contacts 108 are oriented along the inwardly facing surface of the component 104. Any number of contacts 107, 108 may be provided depending on the particular application. In an exemplary embodiment, the contacts 107, 108 are arranged in identical patterns and are generally aligned with one another such that the interconnect device 106 may provide a conductive path between corresponding ones of the contacts 107, 108. However, the pattern of the arrays may be different from one another in alternative embodiments.

The interconnect device 106 includes a substrate 110 holding an array of elastomeric columns 112. The columns 112 extend between opposed ends 114, 116 facing the contacts 107, 108, respectively. The columns 112 are frustoconically shaped, being wider about the midsection and leaner at the ends 114, 116. In an exemplary embodiment, the columns 112 are conductive elastomeric columns, such as columns fabricated from a mixture of an elastic material and conductive flakes. The columns 112 thus provide conductive paths between the first contacts 107 and the second contacts 108. However, the columns 112 may be non-conductive elastomeric columns in alternative embodiments, as described below in further detail.

The substrate 110 includes an inner layer 118 and two outer layers 120. The inner layer 118 is sized to securely retain the columns 112 and in an exemplary embodiment, is received within a circumferential groove 122 of the columns 112. The outer layers 120 may define a compression limit for the elastomeric columns 112 during application of force to the columns 112 by the components 102, 104. Each of the layers 118, 120 is fabricated from an elastic material, such as a polyimide or a silicone rubber material. The layers 118, 120 may be fabricated from different types of materials having different characteristics. The layers 118, 120 are bonded to one another using an adhesive.

The system 100 includes a first array of contact caps 124 positioned between the ends 114 of the elastomeric columns 112 and the corresponding contacts 107. The system 100 also includes a second array of contact caps 126 positioned between the ends 116 of the elastomeric columns 112 and the corresponding contacts 108. The contact caps 124, 126 physically isolate the elastomeric columns 112 from the contacts 107, 108 and allow a metal-to-metal interface at the contacts 107, 108. The isolation limits, and may even completely resist, bonding between the column 112 and the contacts 107, 108. The isolation also limits, and may even completely resist, transfer of the elastic material from the column 112 to the contacts 107, 108.

Figure 2:
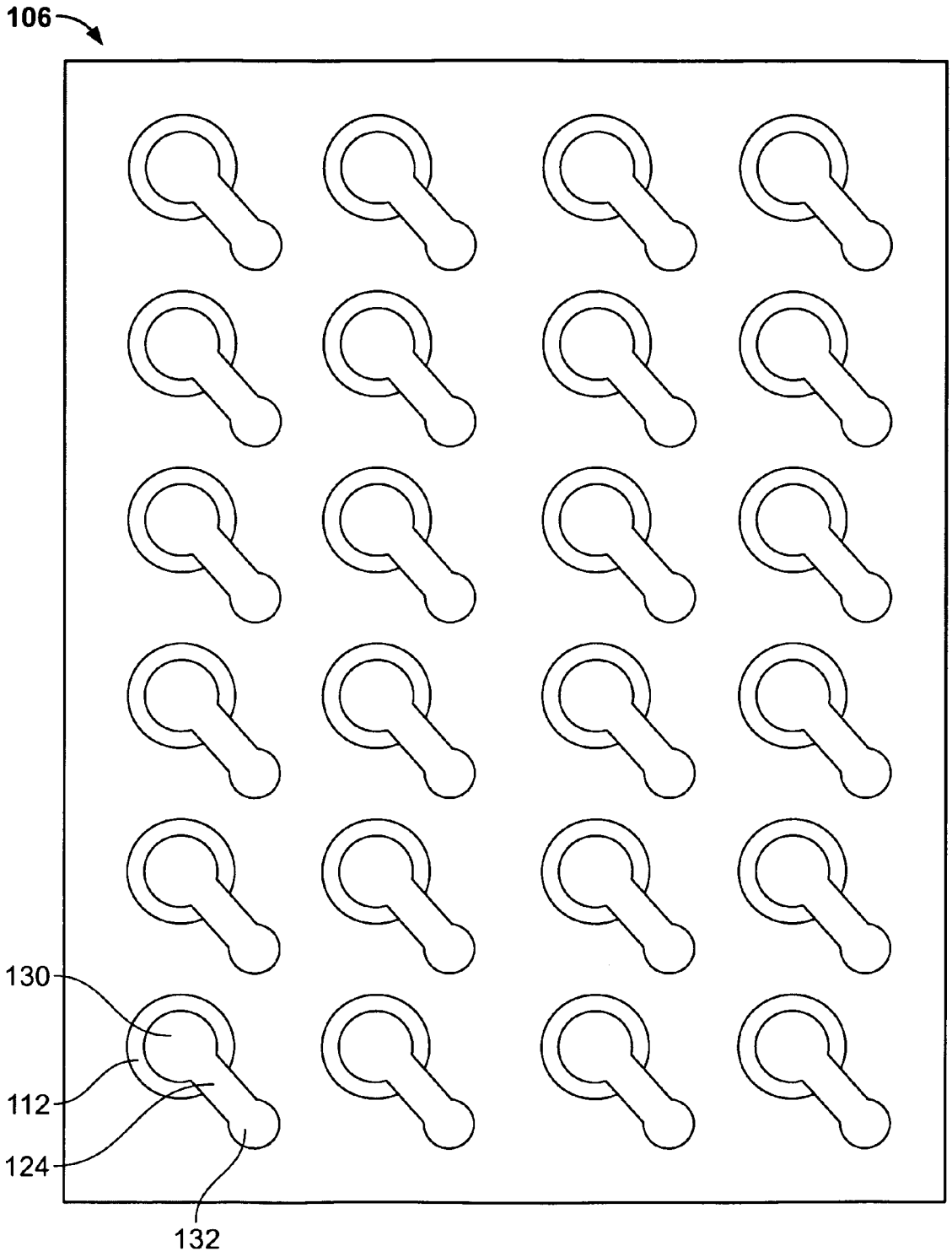
FIG. 2 illustrates an interconnect device for the electrical interconnect shown in FIG. 1.

FIG. 2 illustrates a portion of the interconnect device 106 showing an exemplary pattern for the array of columns 112 and the contact caps 124. The columns 112 and the contact caps 124 are arranged in a matrix of even spaced rows and columns. The pattern corresponds to the pattern of the array of contacts 107, 108.

The contact caps 124 each include a cap portion 130 that cover at least a portion of the end 114 (shown in FIG. 1) of the column 112 and a tail portion 132 extending from the cap portion 130. The tail portion 132 transitions from the exposed surface of the substrate 110 to the cap portion 130, which may be at a different height in the Z direction (shown in FIG. 1) than the substrate 110. In the illustrated embodiment, the distal end of the tail portion 132 is enlarged and the tail portion 132 is oriented at an angle with respect to the rows and columns. Tighter spacing between adjacent columns 112 may be achieved by angling the tail portions 132.

Figure 3:
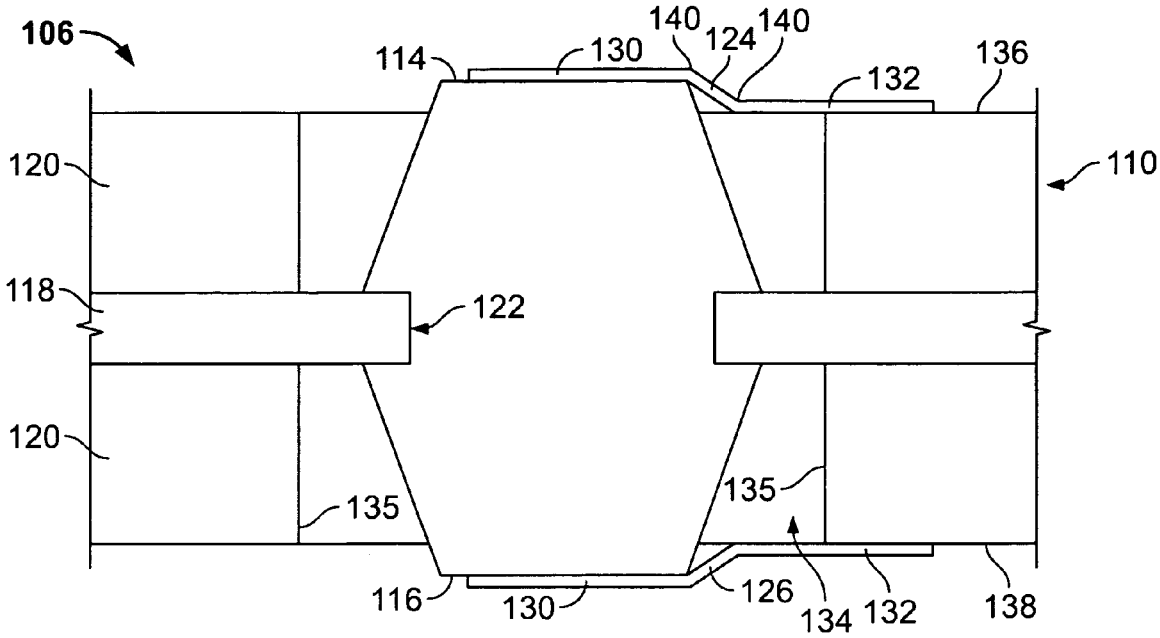
FIG. 3 is a cross sectional view of a portion of the interconnect device shown in FIG. 2.

FIG. 3 is a cross sectional view of a portion of the interconnect device 106. The inner and outer layers 118, 120 of the substrate 110 are arranged in a stack. An opening 134 defined by walls 135 extends through each of the layers 118, 120 between a first outer surface 136 and a second outer surface 138. The opening 134 has a first diameter along the outer layers 120 and a second, smaller diameter along the inner layer 118. In other words, a portion of the inner layer 118 extends into the opening 134 to engage the groove 122 of the column 112. The column 112 is held within the opening 134 such that the end 114 of the column 112 extends beyond the first surface 136 and the end 116 extends beyond the second surface 138. While the walls defining the opening 134 are illustrated as being spaced apart from the outer surface of the column 112, the walls may be proximate to, or even engage, the outer surface of the column 112 in alternative embodiments. Additionally, while the walls are illustrated as being substantially perpendicular to the outer surfaces 136, 138, the walls may be angled, such as at a similar angle as the outer surface of the column 112.

The contact caps 124, 126 extend along the outer surfaces 136, 138 of the substrate 110 and the ends 114, 116 of the column 112. In an exemplary embodiment, at least part of the tail portions 132 of the contact caps 124, 126 are securely coupled to the outer surfaces 136, 138 of the substrate 110 such that the cap portions 130 overlay the openings 134. When the columns 112 are received within the openings 134, the cap portions 130 extend along the ends 114, 116 of the column 112. Optionally, the cap portions 130 may also be securely coupled to the ends 114, 116. The cap portions 130 may be sized to completely cover the ends 114, 116, or alternatively, may cover only a portion of the ends 114, 116. Once the cap portions 130 are positioned along the ends 114, 116, a buffer is created between the ends 114, 116 and the contacts 107, 108 (shown in FIG. 1) when the system 100 is assembled. The buffer maintains separation between, and physically isolates, the ends 114, 116 and the contacts 107, 108, respectively. In one embodiment, to accommodate a variation in Z-height between the ends 114, 116 and the outer surfaces 136, 138, the contact caps 124, 126 may be flexible. For example, the tail portion 132 may bend along joints 140 such that the cap portions 130 lie flat upon the ends 114, 116 and the distal end of the tail portion 132 may lie flat upon the outer surfaces 136, 138.

Figure 4:
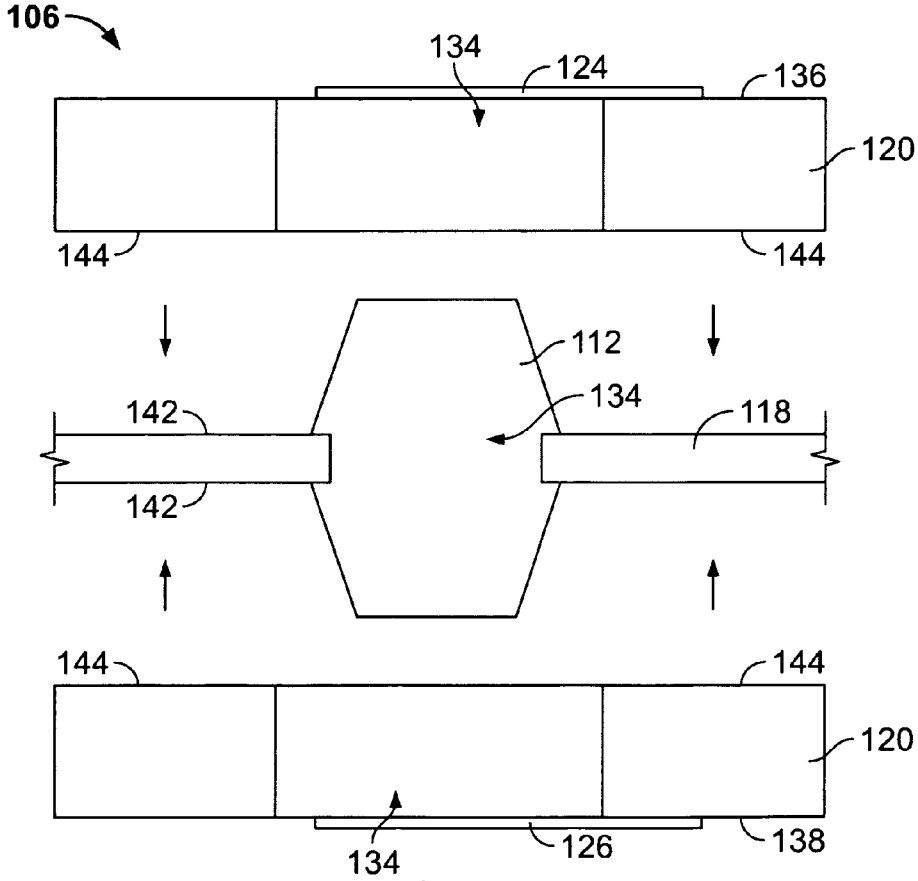
FIG. 4 is an exploded view of the interconnect device shown in FIG. 4.

FIG. 4 is an exploded view of the interconnect device 106, and an exemplary assembly process is described with respect to FIG. 4. Initially, the elastomeric column 112 is secured to the inner layer 118, thus forming a column and inner layer subassembly. To accomplish the securing, the inner layer 118 may be overmolded to the column 112, the column 112 may be loaded through the opening 134 within the inner layer 118, the column 112 may be molded in place within the opening 134 within the inner layer 118, the column 112 may be integrally formed with the inner layer 118, and the like. As illustrated, the inner layer 118 has exposed bonding surfaces 142. Another initial assembly process involves securing the contact caps 124, 126 to the outer layers 120, thus forming cap and outer layer subassemblies. For example, the contact caps 124, 126 may be bonded, or otherwise secured, to the outer surfaces 136, 138. As illustrated, the outer layers 120 include exposed bonding surfaces 144 opposite the outer surfaces 136, 138. The subassemblies are positioned such that the columns 112 are aligned with the openings 134 within the outer layers 120.

A final assembly step involves placing the cap and outer layer subassemblies in contact with the column and inner layer subassembly. In doing so, the exposed bonding surfaces 142 and 144 contact one another, and the bonding surfaces 142, 144 are bonded to one another using a bonding agent, temperature and/or pressure. As the subassemblies are placed in contact, the column 112 forces the cap portions 130 of the contact caps 124, 126 outward, such as to the positions illustrated in FIG. 3.

Figure 5:
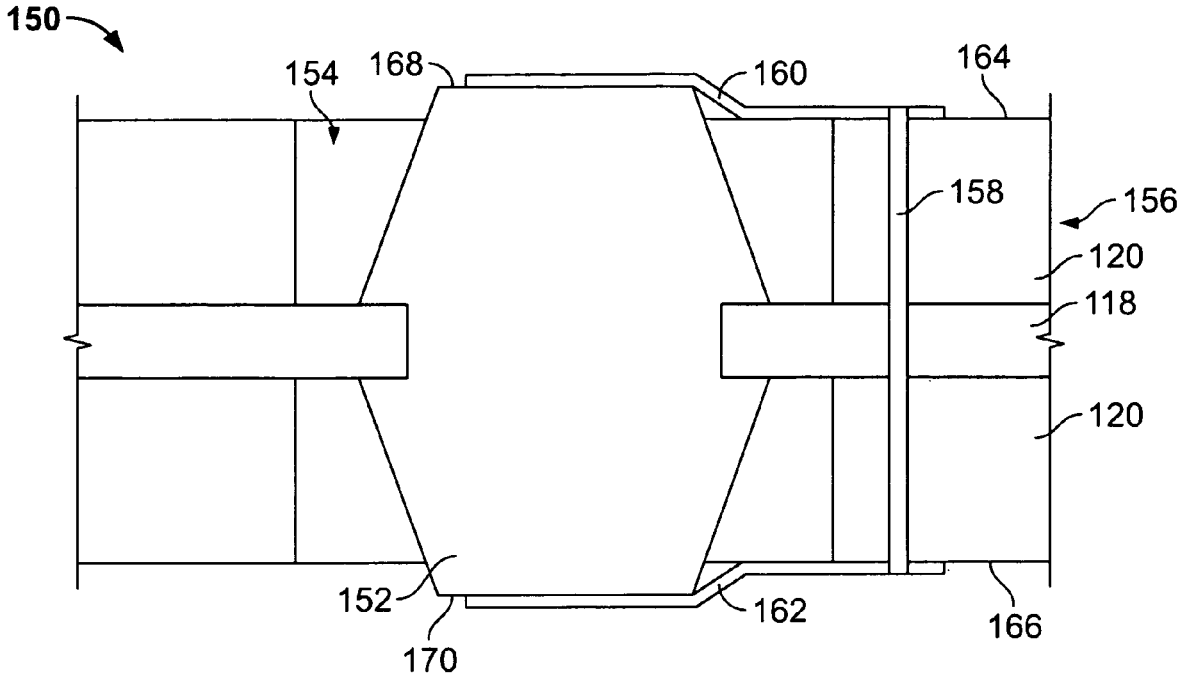
FIG. 5 is a cross sectional view of a portion of an alternative interconnect device formed in accordance with an alternative embodiment.

FIG. 5 is a cross sectional view of a portion of an alternative interconnect device 150 formed in accordance with an alternative embodiment. The interconnect device 150 is similar to the interconnect device 106, however, the interconnect device 150 utilizes a non-conductive elastomeric column 152. The column 152 is securely held within an opening 154 of a substrate 156 similar to the substrate 110 (shown in FIGS. 1-4).

The interconnect device 150 includes a conductive column 158, such as a solder column, extending through the inner and outer layers 118, 120. The conductive column 158 provides a conductive path between a first contact cap 160 and a second contact cap 162. The contact caps 160, 162 are electrically coupled to the conductive column 158 such that a conductive path is created therethrough. Optionally, the conductive column 158 may extend through openings passing through the contact caps 160, 162 such that the conductive column 158 establishes an electrical connection therebetween. The contact caps 160, 162 are separately provided from one another and are not directly coupled to one another. Rather, the conductive column 158 provides the electrical interconnection between the contact caps 160, 162. The conductive column 158 extends completely through the substrate 156 and is exposed at opposed outer surfaces 164, 166 of the substrate 156. The conductive column 158 is spaced apart from the opening 154 through the substrate 156 and may be formed by filling or lining a second opening through the substrate 156 with a conductive material. Alternatively, the conductive column 158 may be a conductive element routed through the substrate 156 such as a pin, a contact, a trace, and the like.

The contact caps 160, 162 are securely coupled to the outer surfaces 164, 166 of the substrate 156, such as by bonding the contact caps 160, 162 thereto. Alternatively, the contact caps 160, 162 may be secured in place by mechanically securing the contact caps 160, 162 to the conductive column 158. The contact caps 160, 162 extend along opposed ends 168, 170 of the column 152 to create a buffer between the ends 168, 170 and the contacts 107, 108 (shown in FIG. 1). The buffer maintains separation between, and physically isolates, the elastomeric column 152 and the contacts 107, 108.

Figure 6:
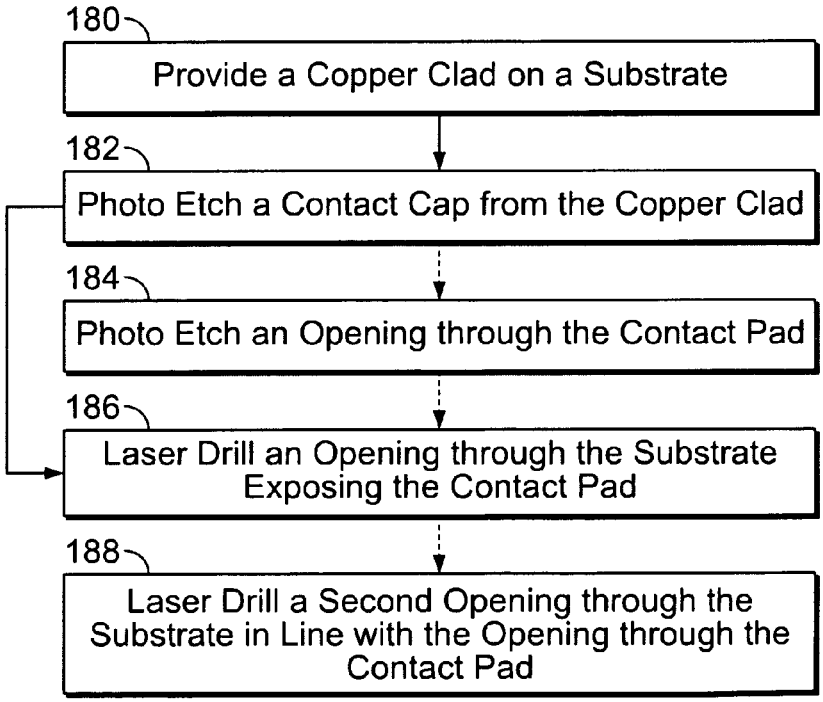
FIG. 6 is a flow diagram illustrating an exemplary process of manufacturing the interconnect devices shown in FIGS. 3-5.

FIG. 6 is a flow diagram of an exemplary process for manufacturing one of the outer layers 120 of the substrate 110 used with the interconnect devices 106 (shown in FIG. 3). Initially, a copper clad is provided 180 on a substrate. At least a portion of the copper clad may be bonded to the substrate or otherwise secured thereto. The copper clad ultimately forms the contact cap 124 (shown in FIG. 1), and other metal clads may be used rather than the copper clad in alternative embodiments. The substrate represents one of the outer layers 120 of the substrate 110.

Next, in an exemplary embodiment, the contact cap 124 is photoetched 182 from the copper clad. In other words, portions of the copper clad are removed from the substrate, leaving other portions that define the contact cap 124. The shape of the remaining portion of the copper clad depends upon the shape of the contact cap 124 desired. In alternative embodiments, other processes are performed rather than photoetching to remove the excess portions of the copper clad, such as chemical etching, machining, stamping, and the like. In some embodiments, an optional step of photoetching 184 an interior portion of the contact cap provides an opening through the contact cap 124. For example, when using an interconnect device using a non-conductive elastomeric column, such as the interconnect device 150 (shown in FIG. 5), the opening through the contact cap 160 allows for the addition of the conductive column 158 after the layers of the substrate 156 are bonded to one another. It is understood that the photoetching steps 182, 184 may be performed prior to step 180, such that formed contact caps may be applied to the substrate 110 rather than forming the contact caps 124 on the substrate 110 as depicted in the exemplary process of FIG. 6.

Next, the opening 134 through the outer layer 120 of the substrate 110 is laser drilled 186, thus exposing the contact pad 124. Other methods of removing the material of the substrate to form the opening 134 may be used in alternative embodiments, such as machining, milling and the like. Additionally, in some embodiments, the openings 134 may be molded within the substrate 110 during forming of the substrate 110. The contact pad 124 is exposed by the opening 134 such that, during assembly of the interconnect device 106, the ends 114 of the columns 112 (shown in FIG. 1) may engage the contact pads 124. In some embodiments, an optional step of laser drilling 188 a secondary opening through the substrate 110 may be used to provide a bore through the substrate 110 for the conductive column 158. The secondary opening is substantially aligned with the opening photoetched through the conductive cap for receiving the conductive column 158. It is understood that the laser drilling steps 186 and 188 may be performed prior to performing steps 180, 182 or 184.

Figure 7:
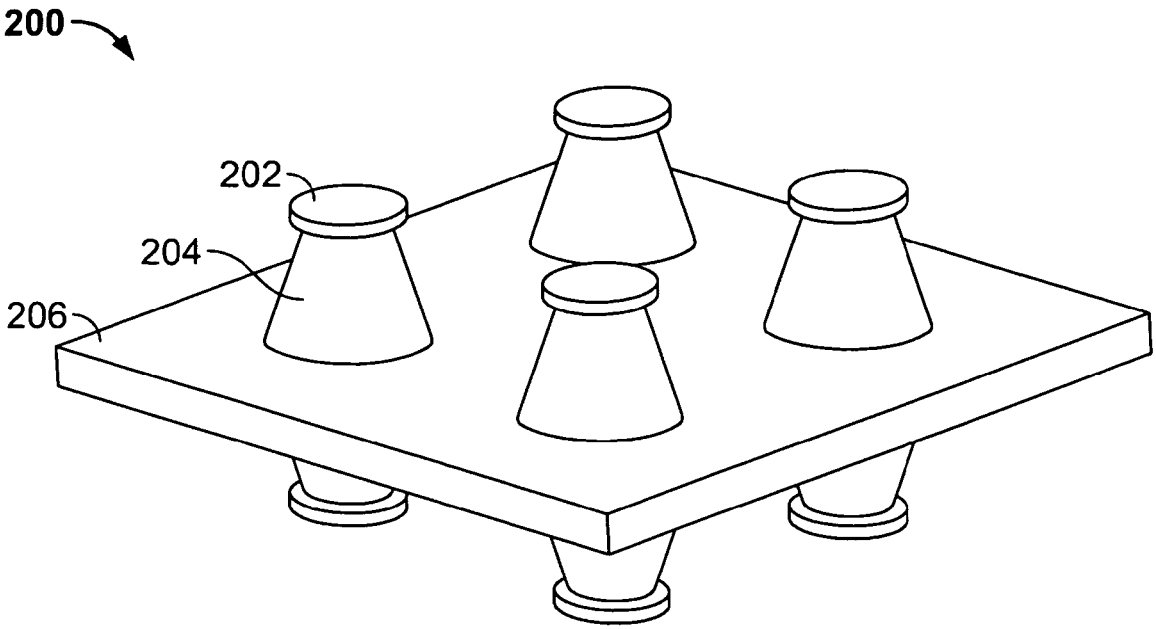
FIG. 7 is a perspective view of an alternative interconnect device formed in accordance with an alternative embodiment.

FIG. 7 is a perspective view of an alternative interconnect device 200 formed in accordance with an alternative embodiment. The interconnect device 200 is similar to the interconnect device 106, however, the interconnect device 200 utilizes contact caps 202 securely coupled to conductive elastomeric columns 204. The columns 204 are securely retained by a substrate 206. In one embodiment, the substrate 206 is overmolded to the columns 204, however, the columns 204 and substrate 206 may be secured to one another in other ways in alternative embodiments. In the illustrated embodiment, the substrate 206 includes a single layer, however, the substrate 206 may include multiple layers, such as the substrate 110 illustrated in FIGS. 1-4.

The contact caps 202 are separately provided from the columns 204, and are mechanically and electrically coupled to the columns 204. In an exemplary embodiment, the contact caps 202 are fabricated from a conductive material, such as silver, nickel, copper, gold, and the like, or alloys of the same. The contact caps 202 are secured to the ends of the columns 204 using a bonding process, such as by using a bonding agent, temperature and/or pressure. Once the contact caps 202 are secured to the columns 204, a conductive path is created from one of the contact caps 202, through the conductive column 204, and to an opposed one of the contact caps 202. Thus the interconnect device 200 provides interconnection between the contacts 107, 108 (shown in FIG. 1) of the electrical components 102, 104 (shown in FIG. 1). Additionally, once the contact caps 202 are secured to the columns 204, a buffer is created between the ends of the columns 204 and the contacts 107, 108. The buffer maintains separation between, and physically isolates, the ends of the columns 204 and the contacts 107, 108.

Figure 8:
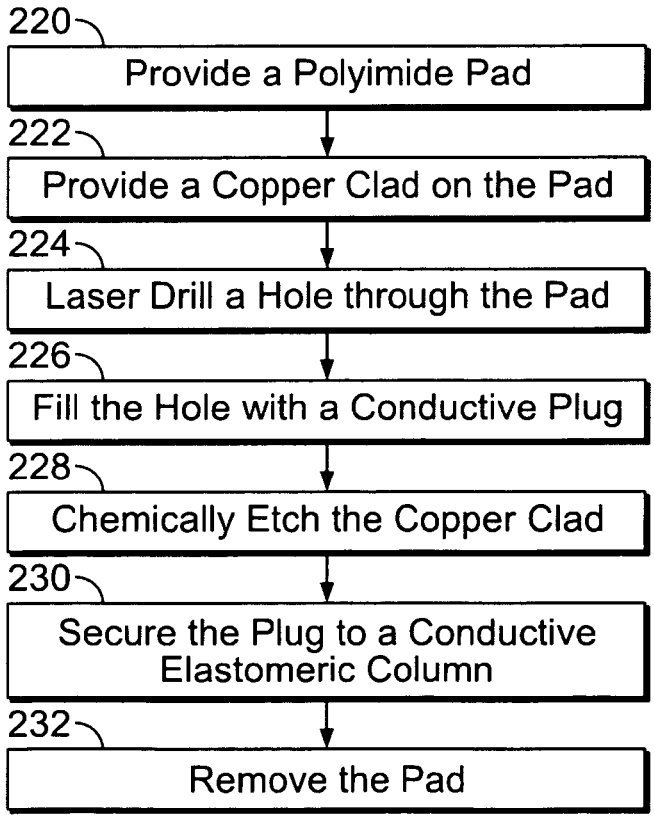
FIG. 8 is a flow diagram illustrating an exemplary process of manufacturing the interconnect device shown in FIG. 7.

FIG. 8 is a flow diagram of an exemplary process of manufacturing the interconnect device 200 (shown in FIG. 7). While the below process is described in terms of forming and applying a single contact cap 202 (shown in FIG. 7) to a single column 204 (shown in FIG. 7), it is realized that multiple contact caps 202 may be formed at one time and applied to multiple columns 204 at one time.

Initially, a polyimide pad is provided 220. The polyimide pad functions as a carrier for the contact cap 202 (shown in FIG. 7), as will be explained in further detail below. The polyimide pad is exemplary and other types of pads, such as pads formed from different types of materials, may be provided and may accomplish similar functions as the polyimide pad. Next, a copper clad is provided 222 on the pad. The copper clad is bonded or otherwise secured to an external surface of the pad. The copper clad functions as a barrier for forming the contact caps 202, as will be explained in further detail below. It is realized that, in alternative embodiments, other metal or non-metal clads may be used rather than the copper clad described herein.

A hole is laser drilled 224 through the pad exposing the copper clad. The hole functions to form the contact cap 202, as will be described below. As will also be evident from the discussion below, multiple holes may be provided when forming a carrier for multiple contact caps 202 such that more than one contact cap 202 may be applied to the columns 204 at one time. In alternative embodiments, the hole in the pad may be formed using other manufacturing or forming methods. For example, the pad may be molded to include the hole. It is also realized that the laser drilling step 224 may be performed prior to the step 222. The shape of the hole defines the shape of the contact cap 202. Thus the hole may be formed into any shape, such as a circular shape, a rectangular shape, or any other shape desired for the contact cap 202. Additionally, the wall defining the hole may be perpendicular to the top surface of the pad, or may be angled from the top surface.

The hole is then filled 226 with a conductive plug. The conductive plug forms the contact cap 202 when the plug is secured to the column 204. By filling, it is meant that the hole may be partially or wholly filled with a material forming the conductive plug. For example, a liquid metal may be poured into the hole, and upon cooling, a solid metal plug remains within the hole and may be transported with the pad. As described above, the copper clad functions as a barrier for forming the contact cap 202. The copper clad forms a bottom of the hole to retain the material forming the plug during filling of the hole. In alternative embodiments, the holes may be filled without using a clad as the bottom. As such, step 222 may be an optional step.

Next, the copper clad is chemically etched 228 from the pad. By removing the copper clad, only the pad and the plug remain and the pad operates as a carrier for the plug. It is realized that other methods may be used to remove the copper clad from the pad, such as photoetching, milling and the like.

The final steps in manufacturing the interconnect device 200 include securing 230 the plug to a conductive elastomeric column, such as the column 204, and removing 232 the pad from the plug. As indicated above, the plug represents the contact cap 202. To secure the contact cap 202 to the column 204, a bonding agent, temperature and/or pressure may be used. Once the contact cap 202 is secured to the column 204, a conductive path is created therebetween. Additionally, once the contact cap 202 is secured to the column 204, the pad is removed 232. The pad may be removed by peeling away the pad. The contact caps 202 may be applied to the columns 204 one at a time, or alternatively, it may be more efficient to apply multiple caps 202 to multiple columns 204 using a single carrier. As such, multiple holes may be drilled in the pad and multiple holes may be filled at the same time. An optional step in manufacturing the interconnect device 200 may be to form the caps 202 to a final shape once the caps 202 are secured to the columns 204.

Referring to the above described embodiments, an electrical interconnect system 100 is provided utilizing contact caps 124, 126 (or contact caps 202 with respect to the embodiment of FIG. 7) between the interconnect device 106 and the contacts 107, 108 of the various electrical components 102, 104. The contact caps 124, 126 create a buffer between the ends 114, 116 of the columns 112 and the contacts 107, 108 (shown in FIG. 1) when the system 100 is assembled. The buffer maintains separation between, and physically isolates, the ends 114, 116 and the contacts 107, 108, respectively. The isolation limits, and may even completely resist, bonding between the column 112 and the contacts 107, 108. The isolation also limits, and may even completely resist, transfer of the elastic material from the column 112 to the contacts 107, 108. The contact caps 124, 126 may be used with either conductive or non-conductive elastomeric columns. Additionally, the contact caps 124, 126 are separate from each other, which provide certain advantages, such as ease of manufacture and assembly.

While the invention has been described in terms of various specific embodiments, those skilled in the art will recognize that the invention can be practiced with modification within the spirit and scope of the claims.

What is claimed is:

1. An electrical interconnect device comprising:

a substrate having opposite outer surfaces;

an array of conductive elastomeric columns held by the substrate, each of the columns having opposite ends that extend beyond respective ones of the outer surfaces of the substrate, each of the columns being internally conductive; and conductive contact caps separately provided from and disposed over the opposite ends of each said column, each contact cap having an inner surface directly engaging one of the ends, each contact cap being electrically connected to the column at the inner surface, and each contact cap having an outer surface being configured to engage a mating contact of an electrical component.

2. An electrical interconnect device in accordance with claim 1 wherein a plurality of the contact caps are held by a carrier and secured to different columns, the carrier being removed from the contact caps after the contact caps are secured to the columns.

3. An electrical interconnect device in accordance with claim 1, wherein each of the contact caps has a tail portion that is adhered to one of the outer surfaces of the substrate and a cap portion that engages the end of the column, the tail portion and the cap portion being formed from a homogenous conductive material.

4. An electrical interconnect device in accordance with claim 1, wherein the outer surfaces of the contact caps are generally planar.

5. An electrical interconnect device in accordance with claim 1, wherein a carrier with a copper clad backing is provided for holding at least one of the contact caps, the carrier includes at least one hole exposing the copper clad and the at least one of the contact caps is formed within the hole, wherein the copper clad is removed after the at least one of the contact caps is formed and the carrier is removed from the at least one of the contact caps after the at least one of the contact caps is secured to the corresponding columns.

6. An electrical interconnect device in accordance with claim 1, wherein the substrate includes an array of openings having a first diameter, the contact caps having a second diameter that is smaller than the first diameter.

7. An electrical interconnect device comprising:

a substrate having an inner layer and two outer layers secured to the inner layer. the outer layers define opposite outer surfaces of the substrate, each of the layers include an array of openings aligned with one another;

an array of conductive elastomeric columns held within the openings by the inner layer, each of the columns having opposite ends that extend beyond respective ones of the outer surfaces of the substrate; and metal contact caps separately provided from the substrate, the contact caps having an inner surface and an outer surface, the inner surface being coupled to the outer surfaces of the substrate such that the contact caps extend at least partially across the openings of the outer layers, the contact caps being disposed over corresponding ends of the columns such that the inner surfaces of the contact caps engage electrically the ends of the columns.

8. An electrical interconnect device in accordance with claim 7, wherein the column includes sides that extend between the opposed ends, and wherein the contact caps include a fixed end coupled to the substrate and a free end opposite the fixed end, the contact cap having an intermediate portion between the fixed and free ends that closely follows and engages at least a portion of the sides of column.

9. An electrical interconnect device in accordance with claim 7 wherein each contact cap comprises a cap portion and a tail portion extending from the cap portion, at least a portion of the tail portion being adhered to one of the outer surfaces, the tail portion and the cap portion being formed from a homogenous conductive material having an inner surface engaging the columns and the substrate, and having an outer surface being configured to engage electrical component contacts of an electrical component.

10. An electrical interconnect device in accordance with claim 7, wherein the contact caps are discrete from one another and individually adhered to the substrate remote from the corresponding opening.

11. An electrical interconnect device in accordance with claim 7, further comprising a conductive column extending through the substrate and engaging opposed ones of the contact caps to create a conductive path between the opposed ones of the contact caps.

12. An electrical interconnect device in accordance with claim 7, wherein the elastomeric column is received within the openings in the outer layers such that the column does not engage the outer layers.

13. An electrical interconnect device for use with an electrical interconnect system having first and second electrical components opposed from one another, each of the first and second electrical components having an array of contacts, the electrical interconnect device comprising:

column and inner layer subassembly having an inner layer body with opposite bonding surfaces and multiple openings and the column and inner layer subassembly having an array of conductive elastomeric columns held within the openings of the inner layer body, each of the columns having opposite first and second ends configured to be aligned with respective ones of the contacts of the first and second electrical components;

a first cap and outer layer subassembly having a first outer layer body and a set of contact caps securely coupled to an outer surface of the first outer layer body, the first set of contact caps lying across the openings in the first outer layer body, each contact cap of the first set being configured to engage a corresponding first electrical component contact; and a second cap and outer layer subassembly having a second outer layer body and a set of contact caps separately provided from the first set of contact caps and securely coupled to an outer surface of the second outer layer body, the second set of contact caps lying across the openings in the second outer layer body, each contact cap of the second set being configured to engage a corresponding second electrical component contact;

wherein the first and second outer layer bodies are coupled to the bonding surfaces of the inner layer body such that the columns are received within openings in the first and second outer layer bodies, the contact caps cover at least a portion of the ends of the columns, the columns force cap portions of the contact caps outward such that the cap portions are non-coplanar with the corresponding outer layer bodies.

14. An electrical interconnect device in accordance with claim 13, wherein the contact caps are adhered to the opposite ends of the columns.

15. An electrical interconnect device in accordance with claim 13, wherein each contact cap comprises a tail portion extending from the cap portion, at least a portion of the tail portion being adhered to one of the outer surfaces.

16. An electrical interconnect device in accordance with claim 13, wherein the contact caps are formed from a homogenous conductive material having an inner surface engaging the columns and the corresponding outer layer bodies, and having an outer surface being configured to engage the corresponding electrical component contact.

17. An electrical interconnect device in accordance with claim 13, wherein each of the contact caps are discrete metal caps individually coupled to the corresponding outer layer bodies remote from the corresponding opening.

18. An electrical interconnect device in accordance with claim 13, wherein the first and second outer layer bodies both have thicknesses that are thicker than a thickness of the inner layer body.

19. An electrical interconnect device in accordance with claim 13, wherein the contact caps are photoetched on the corresponding outer layer bodies.

20. An electrical interconnect device in accordance with claim 13, wherein the set of contact caps are the only portion of the cap and outer layer subassemblies that extend across the ends of the columns.

* * * * *